US006973973B2

(12) United States Patent
Howard et al.

(10) Patent No.: US 6,973,973 B2
(45) Date of Patent: Dec. 13, 2005

(54) GAS OPERATED PUMP FOR HYDROCARBON WELLS

(75) Inventors: William F. Howard, West Columbia, TX (US); William C. Lane, Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 90 days.

(21) Appl. No.: 10/349,501

(22) Filed: Jan. 22, 2003

(65) Prior Publication Data

US 2003/0159828 A1 Aug. 28, 2003

Related U.S. Application Data

(60) Provisional application No. 60/350,673, filed on Jan. 22, 2002.

(51) Int. Cl.[7] ..... E21B 43/16

(52) U.S. Cl. ..... 166/372; 166/50; 166/68; 166/105

(58) Field of Search ..... 166/372, 68, 68.5, 166/105, 50

(56) References Cited

U.S. PATENT DOCUMENTS

| | | | | |
|---|---|---|---|---|
| 3,873,238 A | | 3/1975 | Elfarr | 417/54 |
| 4,344,485 A | | 8/1982 | Butler | 166/271 |
| 4,390,061 A | * | 6/1983 | Short | 166/53 |
| 4,727,936 A | | 3/1988 | Mioduszewski et al. | 166/53 |
| 4,791,990 A | | 12/1988 | Amani | 166/311 |
| 5,215,146 A | * | 6/1993 | Sanchez | 166/272.3 |
| 5,318,124 A | * | 6/1994 | Ong et al. | 166/272.3 |
| 5,373,897 A | | 12/1994 | Skarvan | 166/53 |
| 5,735,346 A | | 4/1998 | Brewer | 166/250.03 |
| 5,806,598 A | | 9/1998 | Amani | 166/372 |
| 5,806,599 A | * | 9/1998 | Hisaw et al. | 166/372 |
| 6,021,849 A | | 2/2000 | Averhoff | 166/372 |
| 6,257,338 B1 | * | 7/2001 | Kilgore | 166/387 |
| 6,354,377 B1 | * | 3/2002 | Averhoff | 166/372 |
| 6,619,402 B1 | * | 9/2003 | Amory et al. | 166/370 |
| 2001/0023614 A1 | | 9/2001 | Tubel et al. | 73/152.39 |
| 2002/0040785 A1 | | 4/2002 | Amani | 166/373 |

FOREIGN PATENT DOCUMENTS

| | | | |
|---|---|---|---|
| WO | WO 98/37306 | 8/1998 | E21B 43/12 |

OTHER PUBLICATIONS

PCT International Search Report, International Application No. PCT/US 03/01744, dated Jun. 16, 2003.

* cited by examiner

*Primary Examiner*—Hoang Dang
(74) *Attorney, Agent, or Firm*—Patterson & Sheridan, LLP

(57) ABSTRACT

The present invention generally relates to an apparatus and method for improving production from a wellbore. In one aspect, a downhole pump for use in a wellbore is provided. The downhole pump includes two or more chambers for the accumulation of formation fluids and a valve assembly for filling and venting gas to and from the two or more chambers. The downhole pump further includes a fluid passageway for connecting the two or more chambers to a production tube. In another aspect, a downhole pump including a chamber for the accumulation of formation fluids is provided. In another aspect, a method for improving production in a wellbore is provided. In yet another aspect, a method for improving production in a steam assisted gravity drainage operation is provided. Additionally, a pump system for use in a wellbore is provided.

37 Claims, 4 Drawing Sheets

STEAM
CONTROL
120
140
145
390
2A
2A
125
115
110
165
130
105
190
185
100
260
195
200
195
135

GAS OPERATED PUMP FOR HYDROCARBON WELLS

CROSS-REFERENCE TO RELATED APPLICATIONS

This application claims benefit of U.S. provisional patent application Ser. No. 60/350,673, filed Jan. 22, 2002, which is herein incorporated by reference.

BACKGROUND OF THE INVENTION

1. Field of the Invention

The present invention relates to artificial lift for hydrocarbon wells. More particularly, the invention relates to gas operated pumps for use in a wellbore. More particularly still, the invention relates to a method and an apparatus for improving production from a wellbore.

2. Background of the Related Art

Throughout the world there are major deposits of heavy oils which, until recently, have been substantially ignored as sources of petroleum since the oils contained therein were not recoverable using ordinary production techniques.

These deposits are often referred to as "tar sand" or "heavy oil" deposits due to the high viscosity of the hydrocarbons which they contain. These tar sands may extend for many miles and occur in varying thicknesses of up to more than 300 feet. The tar sands contain a viscous hydrocarbon material, commonly referred to as bitumen, in an amount, which ranges from about 5 to about 20 percent by weight of hydrocarbons. Bitumen is usually immobile at typical reservoir temperatures. Although tar sand deposits may lie at or near the earth's surface, generally they are located under a substantial overburden or a rock base which may be as great as several thousand feet thick. In Canada and California, vast deposits of heavy oil are found in the various reservoirs. The oil deposits are essentially immobile, therefore unable to flow under normal natural drive or primary recovery mechanisms. Furthermore, oil saturations in these formations are typically large which limits the injectivity of a fluid (heated or cold) into the formation.

Several in situ methods of recovering viscous oil and bitumen have been the developed over the years. One such method is called Steam Assisted Gravity Drainage (SAGD) as disclosed in U.S. Pat. No. 4,344,485, which is herein incorporated by reference in its entirety. The SAGD operation requires placing a pair of coextensive horizontal wells spaced one above the other at a distance of typically 5–8 meters. The pair of wells is located close to the base of the viscous oil and bitumen. Thereafter, the span of formation between the wells is heated to mobilize the oil contained within that span by circulating steam through each well at the same time. In this manner, the span of formation is slowly heated by thermal conductance.

After the oil in the span of the formation is sufficiently heated, the oil may be displaced or driven from one well to the other establishing fluid communication between the wells. At this point, the steam circulation through the wells is terminated and steam injection at less than formation fracture pressure is initiated through the upper well while the lower well is opened to produce draining liquid. As the steam is injected, a steam chamber is formed as the steam rises and contacts cold oil immediately above the upper injection well. The steam gives up heat and condenses; the oil absorbs heat and becomes mobile as its viscosity is reduced allowing the heated oil to drain downwardly under the influence of gravity toward the lower well.

The steam chamber continues to expand upwardly and laterally until it contacts an overlying impermeable overburden. The steam chamber has an essentially triangular cross-section as shown in FIG. 2A. If two laterally spaced pairs of wells undergoing SAGD are provided, their steam chambers grow laterally until they make contact high in the reservoir. At this stage, further steam injection may be terminated and production declines until the wells are abandoned.

Although the SAGD operation has been effective in recovering a large portion of "tar sand" or "heavy oil" deposits, the success of complete recovery of the deposits is often hampered by the inability to effectively move the viscous deposits up the production tubing. High temperature, low suction pressure, high volume with a mixture of sand are all characteristics of a SAGD operation.

Various artificial lift methods, such as pumps, have been employed in transporting hydrocarbons up the production tubing. One type of pump is the electric submersible pump (ESP), which is effective in transporting fluids through the production tubing. However, the ESP tends to gas lock in high temperature conditions. Another type of pump used downhole is called a rod pump. The rod pump can operate in high temperatures but cannot handle the large volume of oil. Another type of pump is a chamber lift pump, commonly referred to as a gas-operated pump. The gas-operated pump is effective in low pressure and low temperature but has low volume capacity. An example of a gas-operated pump is disclosed in U.S. Pat. No. 5,806,598, which is incorporated herein by reference in its entirety. The '598 patent discloses a method and apparatus for pumping fluids from a producing hydrocarbon formation utilizing a gas-operated pump having a valve actuated by a hydraulically operated mechanism. In one embodiment, a valve assembly is disposed at an end of coiled tubing and may be removed from the pump for replacement. Generally, if a SAGD well is not operated efficiently by having an effective pumping system, liquid oil will build in the steam chamber encompassing both the lower and the upper wellbores. If the oil liquid level rises above the upper wellbore and remains at that level, a large amount of oil deposit remains untouched in the reservoir. Due to this problem many wells using the SAGD operation are not recovering the maximum amount of deposits available in the reservoir.

Several other recovery methods have problems similar to a SAGD operation due to an inadequate pumping device. For example, cyclic steam drive is an application of steam flooding. The first step in this method involves injecting steam into a vertical well and then shutting in the well to "soak," wherein the heat contained in the steam raises the temperature and lowers the viscosity of the oil. During the first step, a workover or partial workover is required to pull the pump out past the packer in order to inject the steam into the well. After the steam is injected, the pump must than be re-inserted in the wellbore. Thereafter, the second step of the production period begins wherein mobilized oil is produced from the well by pumping the viscous oil out of the well. This process is repeated over and over again until the production level is reduced. The process of removing and re-inserting the pump after the first step is very costly due to the expense of a workover. In another example, continuous steam drive wells operate by continuously injecting steam downhole in essentially vertical wells to reduce the viscosity of the oil. The viscous oil is urged out of a nearby essentially vertical well by a pumping device. High temperature, low suction pressure, and high pumping volume are characteristics of a continuous steam drive operation. In these conditions, the ESP pump cannot operate reliably due to the high temperature. The rod pump can operate in high temperature but has a limited capacity to move a high volume of oil. In yet another example, methane is produced from a well drilled in a coal seam. The recovery operation to remove water containing dissolved methane is often hampered by the inability of the pumping device to handle the low pressure and the abrasive material which are characteristic of a gas well in a coal bed methane application.

There is a need, therefore, for an improved gas operated pump that can effectively transport fluids from the horizontal portion of a SAGD well to the top of the wellbore. There is a further need for a pump that can operate in low pressure and high temperature conditions with large volume capacity. There is yet another need for a pump that can remain downhole during a cyclic steam drive operation. Furthermore, there is a need for a pump that can operate in low pressure conditions and handle abrasive materials. There is also a final need for a pump to operate in a wellbore where there is no longer sufficient reservoir pressure to utilize gas lift in order to transport the fluid to the surface.

SUMMARY OF THE INVENTION

The present invention generally relates to an apparatus and method for improving production from a wellbore. In one aspect, a downhole pump for use in a wellbore is provided. The downhole pump includes two or more chambers for the accumulation of formation fluids and a valve assembly for filling and venting gas to and from the two or more chambers. The downhole pump further includes a fluid passageway for connecting the two or more chambers to a production tube.

In another aspect, a downhole pump including a chamber for the accumulation of formation fluids is provided. The downhole pump further includes a valve assembly for filling and venting gas to and from the chamber and one or more removable, one-way valves for controlling flow of the formation fluid in and out of the chamber.

In another aspect, a method for improving production in a wellbore is provided. The method includes inserting a gas operated pump into a lower wellbore. The gas operated pump including two or more chambers for the accumulation of formation fluids, a valve assembly for filling and venting gas to and from the two or more chambers and one or more removable, one-way valves for controlling flow of the formation fluid in and out of the one or more chambers. The method further includes activating the gas operated pump and cycling the gas operated pump to urge wellbore fluid out of the wellbore.

In yet another aspect, a method for improving production in a steam assisted gravity drainage operation is provided. The method includes inserting a gas operated pump into a lower wellbore and positioning the gas operated pump proximate a heel of the lower wellbore. The method further includes operating the gas operated pump and cycling the gas operated pump to maintain a liquid level below an upper wellbore.

Additionally, a pump system for use in a wellbore is provided. The method includes a high pressure gas source and a gas operated pump for use in the wellbore. The pump system further includes a control mechanism in fluid communication with the high pressure gas source and a valve assembly for filling and venting the two or more chambers with high pressure gas.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
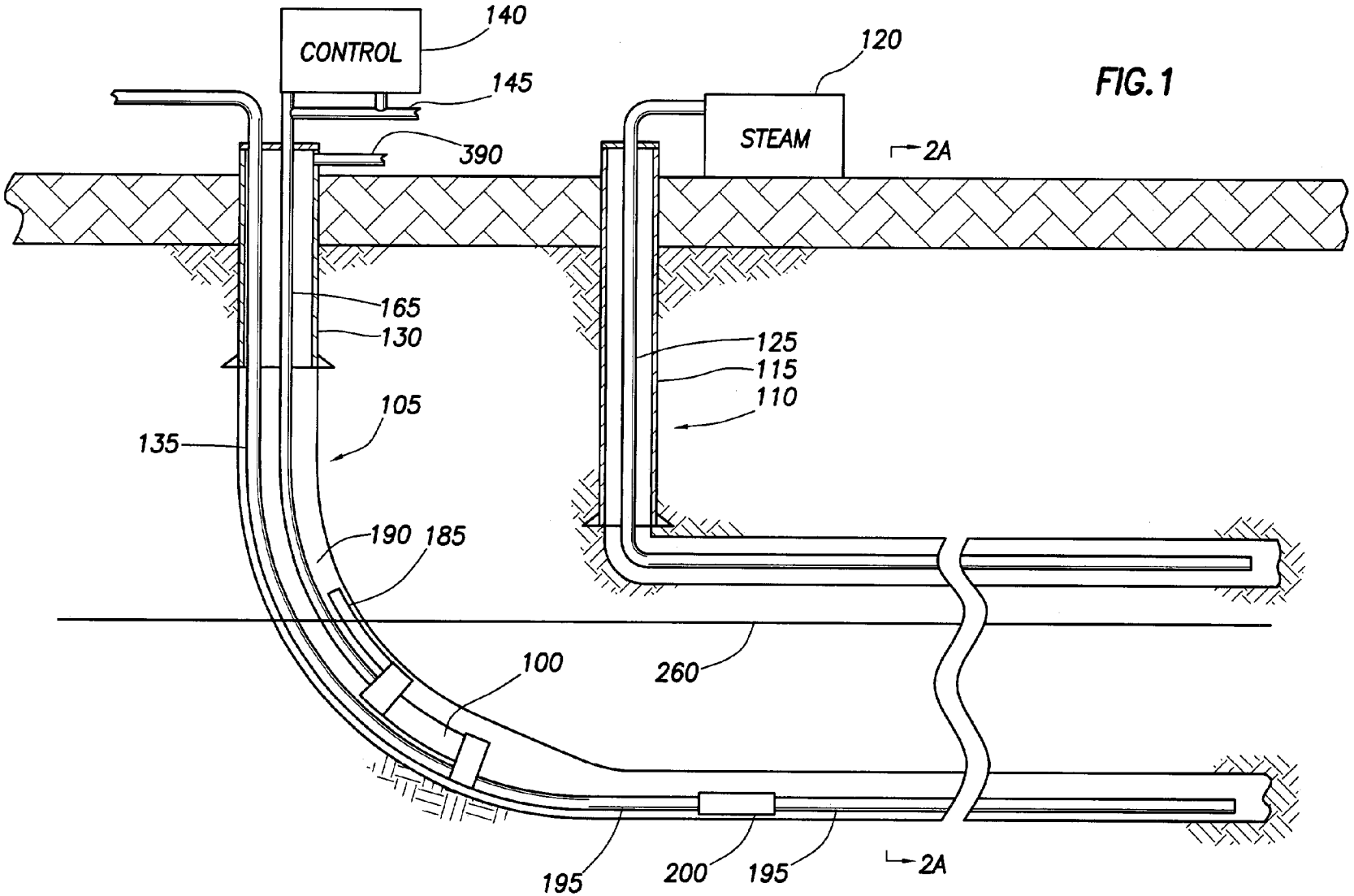
FIG. 1 shows a partial cross-sectional view of a gas-operated pump disposed in a horizontal wellbore for use in a Steam Assisted Gravity Drainage (SAGD) operation.

The present invention includes an apparatus and methods for producing hydrocarbon wells. FIG. 1 shows a partial cross-sectional view of a gas operated pump 100 disposed in a horizontal wellbore for use in a Steam Assisted Gravity Drainage (SAGD) operation. Although FIG. 1 illustrates the pump 100 for use in a SAGD operation, it should be understood that the pump 100 may be employed in many different completion operations such as in vertical or horizontal gas or petroleum wellbores, vertical or horizontal steam drive and vertical or horizontal cyclic steam drive. This invention utilizes high pressure gas as the power to drive the invention. It should be understood that gas refers to natural gas, steam, or any other form of gas. In a typical SAGD operation there are two coextensive horizontal wells, a lower well 105 and an upper injection well 110. As shown in FIG. 1, the upper injection well 110 includes casing 115 on the vertical portion of the wellbore. At the surface connected to the upper well 110, a steam generator 120 is located to generate and inject steam down a steam tube 125 disposed in the wellbore. As illustrated, the lower well 105 is lined with casing 130 on the vertical portion of the wellbore and a screen or a slotted liner (not shown) on the horizontal portion of the wellbore. The lower well 105 includes production tubing 135 disposed within the vertical portion for transporting oil to the surface of the well 105. The pump 100 is disposed close to the lower end of the production tubing 135 and is in a nearly horizontal position near the lowest point of the well 105.

A control mechanism 140 to control the pump 100 is disposed at the surface of the lower well 105. The control mechanism 140 typically provides a hydraulic signal through one or more control conduits (not shown), which are housed in a coil tubing 165 to the pump 100. Alternatively, high pressure gas is used to power control mechanism 140 for the pump 100. In the preferred embodiment, the control mechanism 140 consists of an electric, pneumatic, or gas driven mechanical timer (not shown) to electrically or pneumatically actuate a control valve (not shown) that alternatively pressurizes and vents a signal through one or more control lines to a valve assembly (not shown) in the pump 100. The signal from the control mechanism 140 may be an electrical signal, pneumatic signal, hydraulic signal, or a combination of gas over hydraulic signal to accommodate fluid loss in the hydraulic system and changes in relative volume due to change in temperature. If a hydraulic or gas over hydraulic signal is used, a fluid reservoir is used. If a gas over hydraulic system is used, the same high pressure gas source may power both the control mechanism 140 and provide gas to the pump 100.

Figure 3:
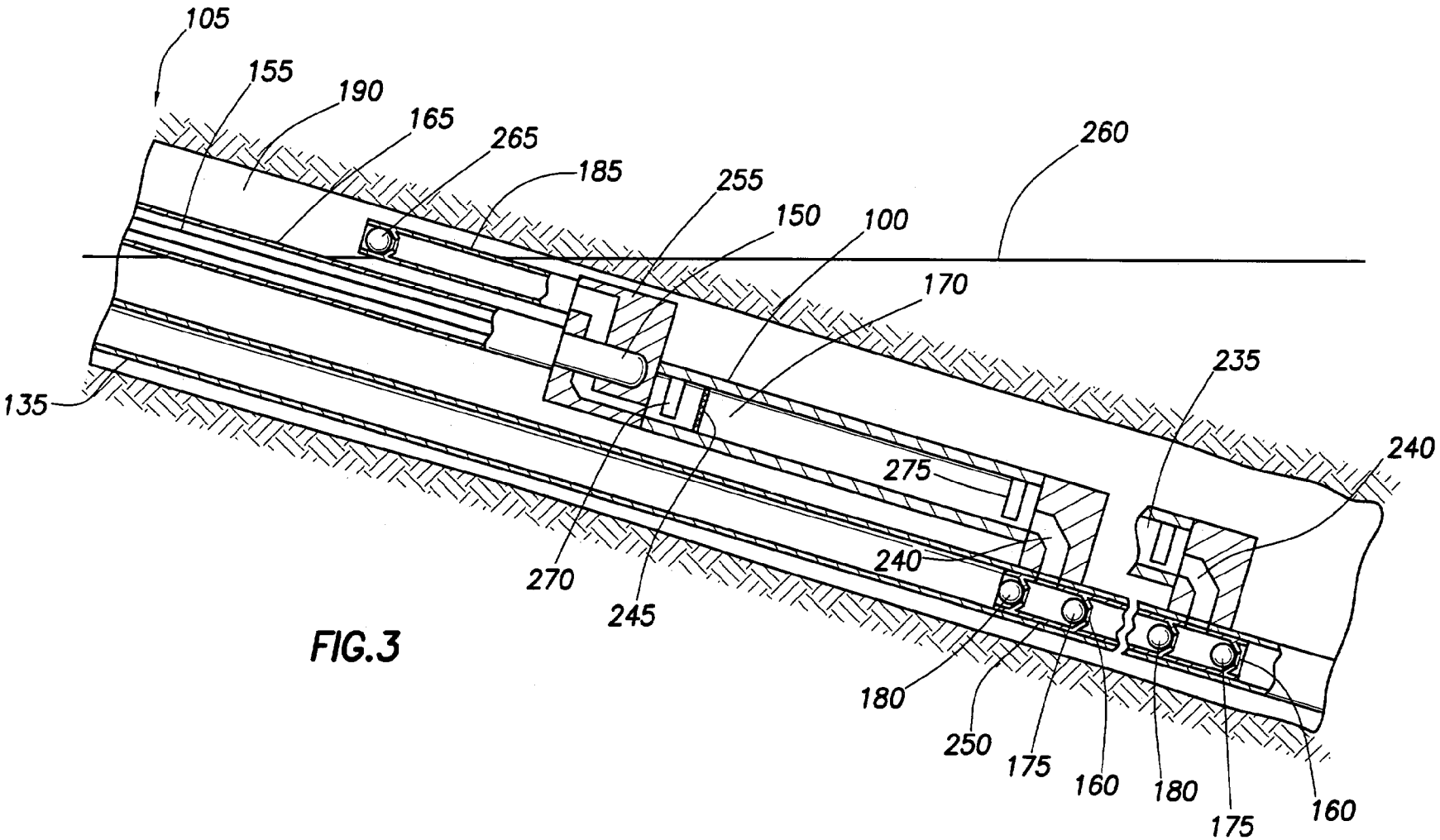
FIG. 3 illustrates a cross-sectional view of the gas operated pump.

Generally, gas is injected from the high pressure gas source (not shown) into a gas supply line 145 and subsequently down the coiled tubing string 165 to a valve assembly 150 disposed in a body of the pump 100. (see FIG. 3). FIG. 3 illustrates a cross-sectional view of the pump 100. The valve assembly 150 controls the input and the venting of gas from a chamber 170. Operational power is brought to the valve assembly 150 by input lines 155. As illustrated in FIG. 3, an aperture 160 at the lower end of the chamber 170 permits formation fluid to flow through a one-way check valve 175 to enter the chamber 170. After the chamber 170 is filled with formation fluid, gas from the coiled tubing string 165 flows through the valve assembly 150 into the chamber 170. As gas enters the chamber 170, gas pressure displaces the formation fluid, thereby closing the first one-way valve 175. As the gas pressure increases, formation fluid is urged into the production tubing 135 through a second one-way valve 180. After formation fluid is displaced from the chamber 170, the valve assembly 150 discontinues the flow of gas from the coiled tubing string 165 and allows the gas in the chamber 170 to exit a vent tube 185 into an annulus 190 formed between the wellbore and the production tubing 135 completing a pump cycle. As the gas operated pump 100 continues to cycle, formation fluid gathers in the tubing 135 and eventually reaches the surface of the well 105 for collection.

In the embodiment illustrated in FIG. 1, a fluid conduit 195 is disposed at the lower end of the pump 100. The fluid conduit 195 extends from the pump 100 to a toe or the furthest point of the lower well 105, thereby allowing production simultaneously from the heel and the toe of the well 105. The fluid conduit 195 also equalizes the pressure and counteracts the pressure change in the horizontal production zone caused by friction loss. Additionally, one or more pumps 200 may be attached to the fluid conduit 195 to encourage fluid flow from the toe of the lower well 105 to the heel.

In another embodiment, the check valves 175, 180 in the pump 100 as illustrated in FIG. 3 can be removed, thereby allowing open flow through the fluid conduit 195 into the production tubing 135. This feature would be useful in the initial steaming operation of a SAGD operation, allowing the operator to move from the first phase of SAGD to the second phase without a workover to install the pump. In another aspect, a deployable cartridge (not shown) can be inserted into the fluid conduit 195 to close fluid flow from the toe of the lower well 105 and allow production exclusively from the heel of the well. Alternatively, another deployable cartridge (not shown) can be inserted in the production tubing 135 to close the flow from the heel of the well 105, thereby encouraging production from the toe of the well and causing more balanced production along the length of the well.

Referring back to FIG. 1, a collection system (not shown) can be used with the pump 100 for a SAGD operation. The collection system is connected to a tube 390 at the surface of the lower well 105. The collection system collects the gas emitted from the pump 100 during the venting cycle and directs the gas to the steam generator 120 for the steaming operation in the upper injection well 110. In this embodiment, one source of high pressure natural gas can be used to power the pump 100 and generate steam without the requirement of an additional energy source. The collection system may be comprised of the following components if required: a condenser to remove moisture from the gas stream, one or more scrubbers to remove carbon dioxide and/or hydrogen sulfide, compressor to compress the gas, or a natural gas intensifier to pressurize the gas.

Figure 2A:
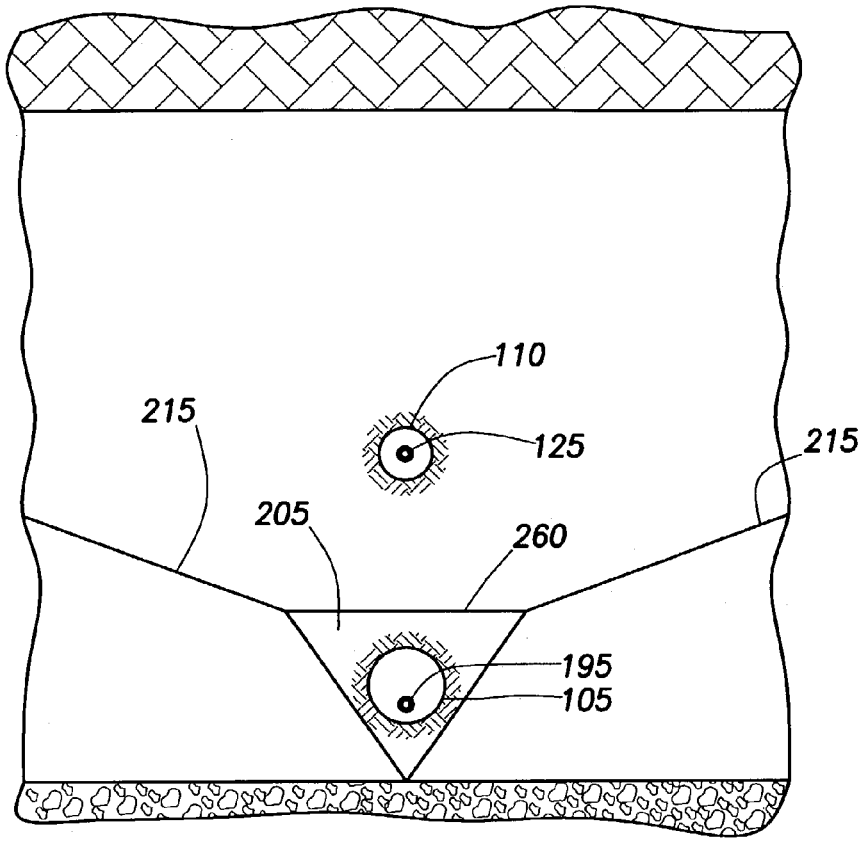
FIG. 2A is a cross-sectional view of the upper and lower well of an optimum SAGD operation.

FIG. 2A is a cross-sectional end view of the upper 110 and lower 105 wells of an optimum SAGD operation. As steam is injected in the upper injection well 110, it rises and contacts the cold oil immediately, there above. As the steam gives up heat and condenses, the oil absorbs the heat and becomes mobile as its viscosity is reduced. The condensate and heated oil thereafter drain under the influence of gravity towards the lower well 105. From the lower well 105, the oil is transported to the surface as described in previous paragraphs. In an optimum SAGD operation, the condensate and heated liquid oil occupy an area depicted by shape 205. The top of the shape 205 is called a liquid level 260. Due to the steam, oil flows inwardly along drainage lines 215 into the area 205. The vertical location of the drainage lines 215 corresponds to the height of the liquid level 260. During the SAGD operation, the liquid level 260 will rise and fall depending on the amount and location of oil in the reservoir. However, to obtain maximum production, the liquid level 260 must remain around the midpoint between the lower well 105 and upper well 110. This is accomplished by using the pump 100 of the present invention to ensure that the oil is efficiently pumped out of the lower well 105. As more and more oil is produced, the drainage lines 215 become increasingly horizontal to a point where production is no longer economical.

Figure 2B:
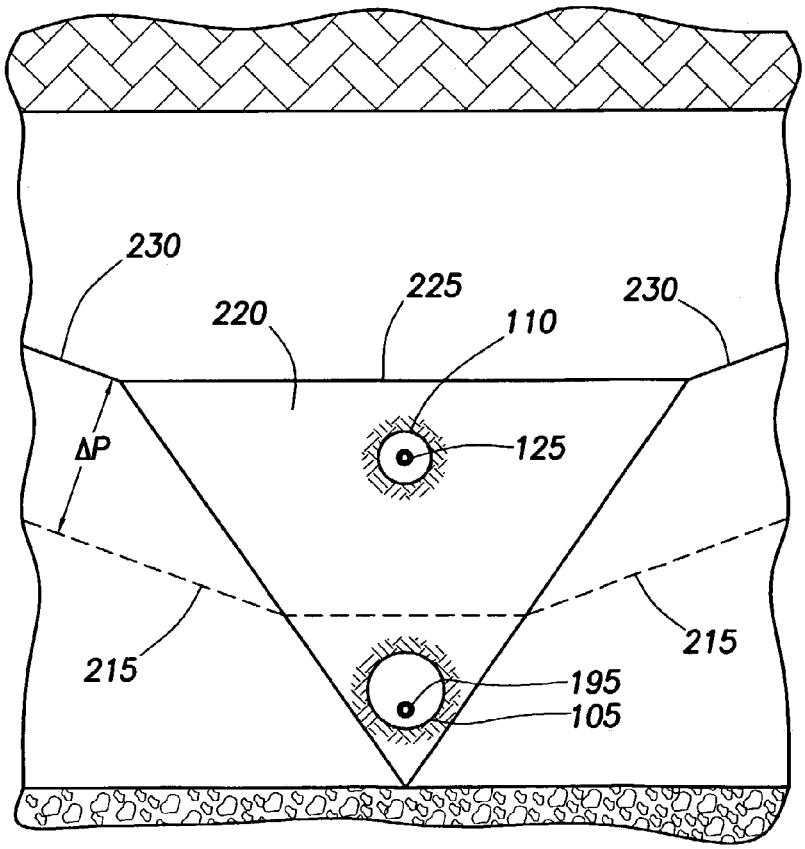
FIG. 2B is a cross-sectional view of the upper and lower well of a less than optimum SAGD operation.

FIG. 2B is a cross-sectional view of the upper well 110 and lower well 105 of a less than optimum SAGD operation. The viscous oil occupies an area depicted by shape 220 with a liquid level line 225. The oil flows inward along drainage lines 230 into the area 220. As illustrated in FIG. 2B, the liquid level line 225 and the drainage lines 230 are above the upper injection well 110. The height of the liquid level line 225 is due to an inadequate pumping device. The reason that the liquid/solid surfaces are more vertical while the drainage lines 230, 215 are closer to horizontal is because the convective, condensing heat transfer with steam is much more efficient than conductive heat transfer (with some convection) through the liquid. The dashed lines represent the drainage lines 215 in an optimum SAGD operation. The amount of unproduced oil that remains in the reservoir after the SAGD operation is complete is indicated by $\Delta P$.

FIG. 3, discussed herein, illustrates a cross-sectional view of the pump 100 that includes the first chamber 170 and a second chamber 235 for the accumulation of formation fluids. The chambers 170, 235 are shown in tandem. However, the invention is not limited to the orientation of the chambers or the quantity of chambers as shown in FIG. 3. For instance, depending on space and volume requirements, two or more chambers may be arranged in series or disposed in any orientation that is necessary and effective. Generally, the first and the second chambers 170, 235 operate in an alternating manner, whereby the first chamber 170 fills with gas and dispels wellbore fluid while the second chamber 235 vents gas and fills with wellbore fluid. At the end of the half cycle, the valve assembly 150 reverses the flow of gas so that the second chamber 235 fills with gas and the first chamber 170 vents the gas. In this respect, the chambers 170, 235 operate in a counter synchronous manner.

The following discussion refers to the cross-sectional view of the complete pump system as shown in FIG. 3. It should be understood that it also applies to any number of pump systems with any number of chambers. A filter element 245 is disposed at the upper end of the chamber 170 or between the chamber 170 and the valve assembly 150 to prevent abrasive particulates from blowing through the valve assembly 150 during the venting cycle. The chamber 170 includes the one-way valve 175 such as a ball and seat check valve or a flapper type check valve at its lower end. The one-way valve 175 allows formation fluids to flow into the chamber 170 through the aperture 160 but prevents the accumulated fluid from flowing back out of the chamber 170 at the lower end of the production tubing 135. The one-way valve 175 is constructed and arranged to be deployable and retrievable through the production tubing 135. To prevent leakage of hydrocarbons from the chamber 170, sealing members (not shown) are arranged around the valve 175. The sealing members can be elastomeric seals, O-ring seals, lip seals, metal loaded lip seals, crushable metal seals, flexible metal seals, or any other sealing member.

A bypass passageway 240 connects the lower end of the production tubing 135 to the lower end of the chamber 170. The one-way valve 180 is disposed in the production tubing 135 at the lower end to allow upward flow of hydrocarbons into the production tubing 135, but preventing downward flow back into the passageway 240. The one-way valve 180 is constructed and arranged to be deployable and retrievable through the production tubing 135. Sealing members (not shown) are arranged around the valve 180 to create a fluid tight seal, thereby preventing leakage of hydrocarbons from the production tubing 135.

In the preferred embodiment, the valves 175, 180 are shown in a single deployable cartridge 250 permitting the valves 175, 180 to be deployed and retrieved together as an assembly. It should be noted, however, that this invention is not limited to the embodiment shown in FIG. 3. For instance, depending on space requirements and ease of removal, one or more valves 175, 180 may be mounted independent from each other so that one or more valves 175, 180 can be removed. The ability to deploy and retrieve the one-way valves 175, 180, either as the deployable cartridge 250 as shown in FIG. 3, or independently, provides an opportunity to remove the valves 175, 180 in order to gain access to the wellbore beyond the pump 100 through the production tubing 135. This feature can be used for well maintenance operations such as removal of sand blockage from the production zone or replacement of the valves.

The valve assembly 150 in the pump 100 consists of a single or double actuator (not shown) for controlling the input and output of the gas in the chamber 170. In FIG. 3, the valve assembly 150 is shown connected to coiled tubing 165 that houses one or more control conduits 155 and provides a passageway for gas. The control conduits 155 are typically hydraulic control lines and are used to actuate the valve assembly 150. Additionally, electric power or pressurized gas can be transmitted through the one or more control conduits 155 to actuate the valve assembly 150. Valve assembly 150 may include data transmitting means to transmit data such as pressure and temperature within the chamber 170 or the wellbore annulus 190 through the one or more control conduits 155 to the surface of the wellbore. The valve assembly 150 may include a sensing mechanism (not shown) to sense the liquid level of a SAGD operation. A resistivity log may be created based upon the particular well and used to determine the liquid level. If the sensor (not shown) determines the liquid level is too high, a signal is sent to the control 140 of the pump 100 to speed up the pump cycle. If the sensor determines that the liquid level is too low, a signal is sent to the control 140 of the pump 100 to slow down the pump cycle. In these instances, the valve assembly 150 or a valve housing 255 may include sensors, or a separate conduit may deploy the sensors. Data transmitting means can include fiber optic cable. The valve housing 255 may be located at the upper end of the chamber 170 as illustrated, or it may be located elsewhere in the wellbore and be connected to the chamber 170 by a fluid conduit (not shown).

In one embodiment, the pump 100 includes a removable and insertable valve assembly 150. In one aspect, the invention includes a pump housing (not shown) having a fluid path for pressurized gas and a second fluid path for exhaust gas. The fluid paths are completed when the valve 150 is inserted into a longitudinal bore formed in the housing. The removable and insertable valve assembly 150 is fully described in U.S. patent application Ser. No. 09/975,811, with a filing date of Oct. 11, 2000, and U.S. Pat. No. 5,806,598, to Mohammad Amani, both are herein incorporated by reference.

The valve assembly 150 consists of an injection control valve (not shown) for controlling the input of the gas into the chamber 170 and a vent control valve (not shown) for controlling the venting of the gas from the chamber 170 exiting out the vent tube 185. As shown in FIG. 3, the vent tube 185 extends to a point that is above the formation liquid level 260 at the highest point of the pump 100, which is the preferred embodiment. This arrangement increases the hydrostatic head available during the fill cycle, allowing the chamber 170 to fill quickly and reduces any resistance during the vent cycle. It is desirable to prevent liquid from entering the vent tube 185 because as it is expelled during the vent cycle it may cause erosion of the wellbore and can prematurely cause failure of the valve assembly 150. In order to prevent liquid from entering the vent tube 185, a one-way check valve 265 is disposed at the upper end of the vent tube 185, thereby allowing the gas to exit but preventing liquid from entering. Additionally, a velocity reduction device (not shown) is disposed at the end of the vent tube 185 to prevent erosion of the wellbore. The velocity reduction device has an increased flow area as compared to the vent tube 185, thereby reducing the velocity of the gas exiting the vent tube 185. The velocity reduction device may include a check valve (not shown) disposed at an upper end to allow gas to exit while preventing liquid from entering the device. In another embodiment, pressurized gas from the coiled tubing 165 or another conduit may be vented through a nozzle (not shown) to the production tubing 135 reducing the density of the fluid in the production tubing 135. This type of artificial lift is well known in the art as gas lift.

Controlling the amount of liquid and gas in the chamber 170 during a pump cycle is important to enhance the performance of the pump 100. The fill cycle occurs when the valve assembly 150 allows the chamber 170 to be filled with gas displacing any fluid in the chamber 170, and the vent cycle occurs when the valve assembly 150 allows the gas in the chamber 170 to vent while filling the chamber 170 with fluid. During the vent cycle, the amount of liquid contacting the valve assembly 150 should be minimized in order to prevent premature failure or erosion of the valve assembly 150. During the fill cycle, the amount of gas entering the production tubing 135 should be minimized in order to prevent erosion of the production tubing 135. A top sensor 270 is disposed at the upper end of the chamber 170 to trigger the valve assembly 150 to start the fill cycle when the liquid level reaches a predetermined point during the vent cycle. A bottom sensor 275 is disposed at the lower end of the chamber 170 to trigger the valve assembly 150 to start the vent cycle when the liquid level reaches a predetermined point during the fill cycle. There are many different types of sensors that can be used; therefore, this invention is not limited to the following discussions of sensors.

In one embodiment, the top and bottom sensors 270, 275 are constructed and arranged having a sliding float (not shown) that moves up and down on a gas/liquid interface and a sensing device to trigger the valve assembly 150. In this embodiment, the sliding float is constructed to be a little smaller than the inside of the chamber 170 to minimize the frictional forces generated between the sliding float and the upper surface of the chamber 170. This arrangement allows the differential pressure caused by the restriction of the flow in the annulus between the float and the chamber to encourage the movement of the sliding float down the chamber 170. The sensor in this embodiment can be a mechanical linkage, electrical switch, pilot valve, bleed sensor, magnetic proximity sensor, ultrasonic proximity sensor, or any other senor capable of detecting the position of the float and triggering the valve assembly 150.

In another embodiment, the top and bottom sensors 270, 275 are constructed and arranged having a float (not shown) that is supported with a hinge or flexible support such that a control orifice is covered when the float is in the up position and uncovered when the float is in the down position. In this embodiment, the orifice is supplied with a flow of control gas. When the orifice is covered, the control gas pressure builds to a level higher than the pressure in the chamber 170 containing the float. When the orifice is uncovered, the control gas pressure is released and equalizes at a pressure slightly above the pressure of the chamber 170. This difference between the high pressure and the low pressure is used to shift the valve assembly 150. Alternatively, the sensor in this embodiment can be any of the above-mentioned sensors, which are capable of detecting the position of the float and triggering valve assembly 150.

In another embodiment, the top and bottom sensors 270, 275 are constructed and arranged having a flow constriction (not shown) in the chamber 170 containing the gas and liquid and a target against which the flow of the gas or liquid is directed as it flows through the constriction. The constriction of the flow causes the velocity of the fluid to be higher than the velocity of the fluid moving up or down in the chamber. The volumetric flow rate of liquid through the inlet to the chamber 170 is approximately equal to the volumetric gas flow through the outlet of the chamber 170, which is approximately equal to the volumetric flow of the gas or liquid flowing through the constriction in the chamber 170. All three volumetric flows remain approximately constant throughout the fill cycle. The force exerted by the fluid against the target is then proportional to the density of the fluid, and it is also dependent on the velocity which is essentially constant. Since the density of the liquid is much higher than the density of the gas, the force exerted on the target is much less when the fluid flowing through the restriction is a gas, and the force level increases dramatically when the liquid level rises so that the liquid flows through the restriction. In this embodiment various components can be used to transmit the force from the target to operate the control valve such as bellows filled with hydraulic fluid, a diaphragm to transmit force mechanically, a diaphragm to transmit force hydraulically, or by transmitting the force directly from the target to a pilot control valve. The invention may use any type of component and is not limited to the above list.

In another embodiment, the top and bottom sensors 270, 275 are constructed and arranged having a baffle or other restriction (not shown) that restricts the flow of fluid through the chamber 170 of the pump 100, with a differential pressure sensor attached at either side of the restriction. The differential pressure across the restriction in the chamber 170 is primarily dependent on the density of the fluid since the volumetric flow, and therefore velocity, is essentially constant. The differential pressure sensor transmits a mechanical, electrical, or fluid pressure signal to change the control state of the valve assembly 150.

Figure 4:
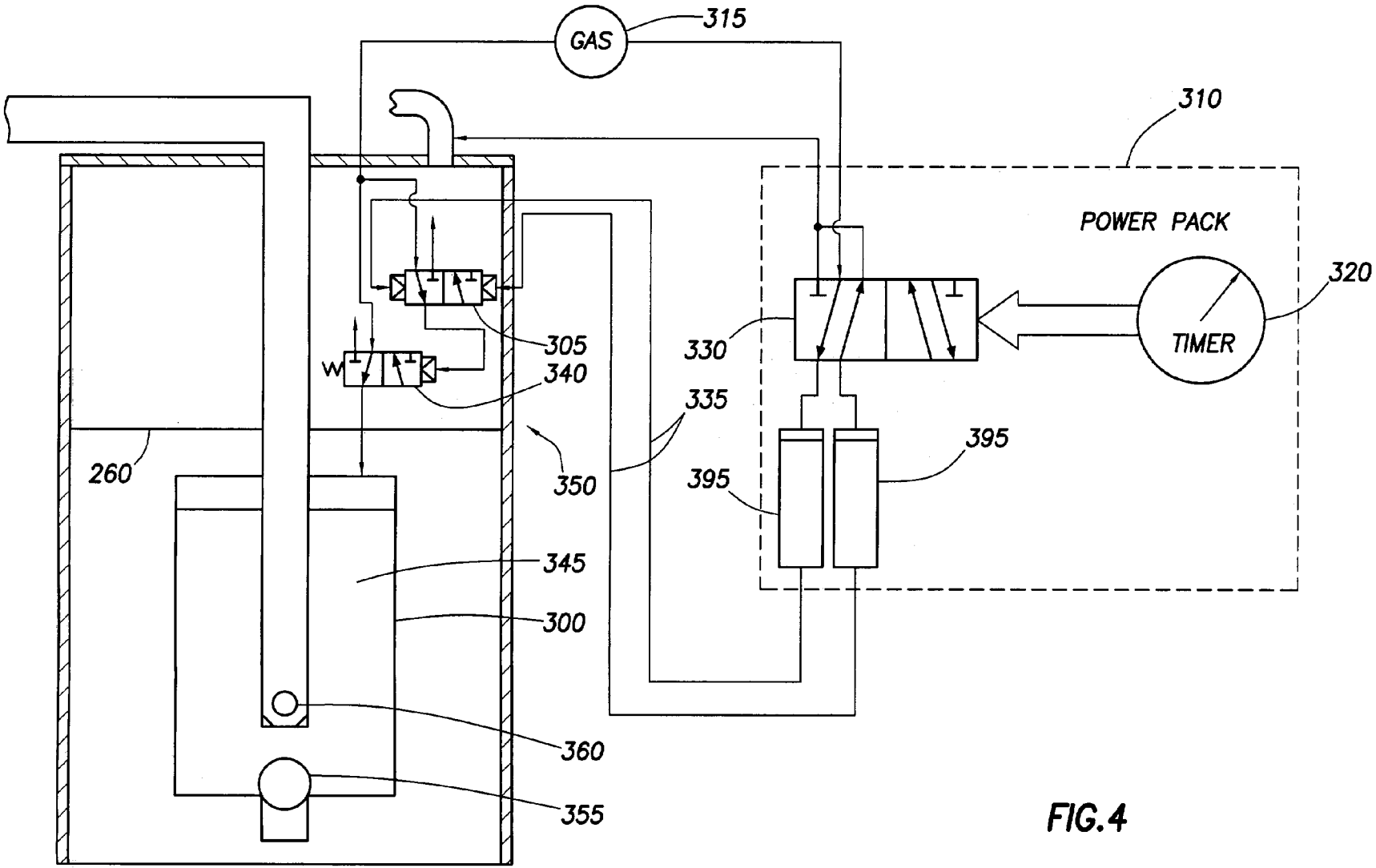
FIG. 4 illustrates a gas operated pump disposed in a wellbore with a pilot valve.

FIG. 4 illustrates another embodiment of a gas operated pump 300 disposed in a well bore 350. The embodiment illustrated includes the pump 300 with a single control mechanism 310 and a single pilot valve 305. However, it should be understood that this embodiment may apply to any quantity of pumps with one or more chambers, with one or more control mechanisms, and one or more pilot valves. Generally, high pressure gas 315 provides the power to the pump 300 and the control mechanism 310. The control mechanism 310 is located near the surface of the wellbore 350 and uses the high pressure gas 315 to send a hydraulic actuation signal to the pump 300. The control mechanism 310 consists of an electric, pneumatic, or gas driven mechanical timer 320 that electrically or pneumatically actuates one or more surface control valves 330 that alternatively send a pressure signal to one or more pressurizable chambers 395 containing hydraulic fluid. Thus, the pressure signal is converted from a gas to a hydraulic signal that is conducted through one or more control lines 335 to the pilot valve 305 located downhole. The pilot valve 305 sends a signal to a valve assembly 340 which is located above a formation liquid level 260. The valve assembly 340 fills and vents a chamber 345 causing fluid to flow through valves 355, 360, thereby completing the pumping cycle as discussed previously. The signal from the control mechanism 310 may be an electrical signal, pneumatic signal, hydraulic or gas over hydraulic signal. The purpose of the volume in chamber 395 is to accommodate fluid loss in the hydraulic system and changes in relative volume due to change in temperature.

In the preferred embodiment, the control mechanism 310 uses a hydraulic signal that actuates the pilot valve 305 with a spool valve construction. Additionally, the valve assembly 340 comprises a pressurizing valve (not shown) to fill the chamber 345 and a venting valve (not shown) to vent the chamber 345. The pressurizing valve is essentially hydrostatically balanced. Generally, the valve spool in the pressurizing valve is arranged so that the inlet pressure acts upon equal areas of the spool in opposite directions in all valve positions. The inlet pressure produces force to open and close the valve spool in a balanced fashion so that the inlet pressure does not bias the valve in either the opened or the closed direction. Furthermore, the outlet pressure also acts upon equal areas of the spool in opposite directions in all valve positions assuring that the outlet pressure produces forces to open and close the valve spool in a balanced fashion so that the outlet pressure does not bias the valve in either the opened or the closed direction. This type of construction allows the only unbalanced force acting on the valve spool to be the actuating force, thereby greatly reducing the required actuating force and increasing the responsiveness of the valve.

The venting valve is essentially hydrostatically balanced to reduce the required actuating force and to increase the responsiveness of the venting valve. Generally, the valve spool in the venting valve is arranged so that the inlet pressure acts upon equal areas of the spool in opposite directions in all valve positions. The inlet pressure produces forces to open and close the valve spool in a balanced fashion so that the inlet pressure does not bias the valve in either the opened or the closed direction. Furthermore, the outlet pressure also acts upon equal areas of the spool in opposite directions in all valve positions so that the outlet pressure produces forces to open and close the valve spool in a balanced fashion so that the outlet pressure does not bias the valve in either the opened or the closed direction.

In another embodiment, one or more intermediate pilot valves may be used in conjunction with the pilot valve 305 to actuate the valve assembly 340 in the pump 300. In a different aspect, the venting valve is constructed so that the flow is entering the valve seat axially through the valve seat and flowing in the direction of the valve plug. The valve plug is mounted so that as the valve opens the valve plug moves away from the direction of fluid flow as the fluid moves through the valve seat to minimize the length of time that the valve plug is subjected to impingement of the high velocity flow of gas that was possibly contaminated with abrasive particles when it came in contact with the wellbore fluid. To increase longevity, the valve plug can be made from a resilient material or a hard, abrasion resistant material with a resilient sealing member around the valve plug and protected from direct impingement of the flow by the hard end portion of the valve plug.

In another embodiment of this invention, a well with a gas operated pump is used with a liquid/gas separator. The separator is located at the surface of the well by the production tubing outlet. The separator is arranged to remove gas from the liquid stream produced by the pump, thereby reducing the pressure flow losses in the liquid collection system. Additionally, the gas in the separator can be vented to the annulus gas collection system which is used as a gas supply source for the steam generator in a SAGD operation or any other steaming operation.

In another embodiment, a gas operated pump is used in a continuous or cyclic steam drive operation. Generally, the pump is disposed in a well as part of the artificial lift system. In a cyclic steam drive operation, the pump does not need to be removed during the steam injection and soak phase but rather remains downhole. In the second phase the pump is utilized to pump the viscous oil to the surface of the well.

In another embodiment, the pump can be used to remove water and other liquid material from a coal bed methane well. The pump is disposed at the lower portion of the well to pump the liquid in the coal bed methane well up production tubing for collection at the surface of the well.

Improving production in a wellbore can be accomplished with methods that use embodiments of the gas operated pump as described above. A method for improving production in a wellbore includes inserting a gas operated pump into a lower wellbore. The gas operated pump including two or more chambers for the accumulation of formation fluids, a valve assembly for filling and venting gas to and from the two or more chambers and one or more removable, one-way valves for controlling flow of the formation fluid in and out of the one or more chambers. The method further includes activating the gas operated pump and cycling the gas operated pump to urge wellbore fluid out of the wellbore.

While the foregoing is directed to embodiments of the present invention, other and further embodiments of the invention may be devised without departing from the basic scope thereof, and the scope thereof is determined by the claims that follow.

What is claimed is:

1. A method for improving production in a wellbore, comprising:

inserting a gas operated pump into a lower wellbore, the gas operated pump including:

two or more chambers for the accumulation of formation fluids;

a valve assembly for filling and venting gas to and from the two or more chambers; and one or more removable one-way valves for controlling flow of the formation fluid in and out of the one or more chambers;

activating the gas operated pump;

cycling the gas operated pump to urge wellbore fluid out of the wellbore; and filtering particulate matter entering the valve assembly when gas vents from the two or more chambers.

2. The method of claim 1, further including positioning an inlet of the gas operated pump proximate the lowest point of the wellbore.

3. The method of claim 1, further including injecting steam into another wellbore for use in a steam drive oil production.

4. The method of claim 3, wherein the steam drive oil production includes a steam assisted gravity drainage oil production.

5. The method of claim 4, further including cycling the gas operated pump to maintain a liquid level in a producing formation just above the lower wellbore.

6. The method of claim 1, wherein the one or more removable one-way valves are constructed and arranged to allow them to be deployable and removable through a production tube.

7. The method of claim 1, further including removing the one or more removable one-way valves to allow access to the lower wellbore.

8. The method of claim 1, further including placing a fluid conduit at the lower end of the gas operated pump, the fluid conduit extending from a heel to a toe of the lower wellbore.

9. The method of claim 8, further including connecting an additional pump to the fluid conduit to encourage flow from the toe to the heel.

10. The method of claim 8, further including producing simultaneously from the heel and the toe of the lower wellbore.

11. The method of claim 8, further including inserting a deployable cartridge into the production tubing to close the flow of formation fluid in the toe of the lower well, thereby allowing production only from the heel of the lower well.

12. The method of claim 1, wherein a collection system is operatively attached to the gas operated pump.

13. The method of claim 1, wherein power lines are connected to the valve assembly to operate the gas operated pump.

14. The method of claim 13, further including transmitting data such as pressure and temperature within the downhole pump through a data transmitting means disposed in the power lines.

15. The method of claim 1, wherein a sensing mechanism is operatively connected to the valve assembly to sense a liquid level in the wellbore.

16. The method of claim 15, further including increasing the speed of the downhole pump when the liquid level is high by sending a signal from the sensing mechanism to a control mechanism.

17. The method of claim 15, further including decreasing the speed of the downhole pump when the liquid level is low by sending a signal from the sensing mechanism to a control mechanism.

18. The method of claim 1, wherein a top sensor is disposed at an upper end of the two or more chambers to trigger the valve assembly to fill the two or more chambers with gas when the liquid level reaches an upper predetermined point in the one or more chambers.

19. The method of claim 1, wherein a bottom sensor is disposed at a lower end of the two or more chambers to trigger the valve assembly to vent the two or more chambers when the liquid level reaches a lower predetermined point in the two or more chambers.

20. The method of claim 1, further including communicating a portion of the gas through a nozzle to a production tube to decrease the density of the wellbore fluid therein, whereby the nozzle is disposed proximate the valve assembly.

21. The method of claim 1, further including removing the valve assembly from a valve housing and inserting another valve assembly into the valve housing.

22. The method of claim 1, further including injecting pressurized gas into the wellbore fluid to reduce the density of the fluid.

23. A pump system for use in a wellbore, comprising:

a high pressure gas source;

a gas operated pump for use in the wellbore, the gas operated pump including:

two or more chambers for the accumulation of formation fluids; and two or more removable one-way valves for controlling flow of formation fluid in and out of the two or more chambers;

a control mechanism in fluid communication with the high pressure gas source, wherein the control mechanism utilizes the high pressure gas source to send a signal to actuate the gas operated pump;

a valve assembly in direct fluid communication with the high pressure gas source for filling and venting the two or more chambers with high pressure gas; and a pilot valve operatively attached to the valve assembly for receiving a signal from the control mechanism and sending a signal to the valve assembly.

24. The pump system of claim 23, wherein the control mechanism includes a timer that actuates a surface control valve.

25. The pump system of claim 24, wherein the surface control valve sends a signal to one or more pressurizable chambers containing hydraulic fluid.

26. The pump system of claim 25, wherein the one or more pressurizable chambers send a hydraulic signal to the control valve to actuate the gas operated pump.

27. A downhole pump for use in a wellbore, comprising:

two or more chambers for the accumulation of formation fluids;

a valve assembly for filling and venting gas to and from the two or more chambers;

a fluid passageway for connecting the two or more chambers to a production tube; and a velocity reduction device operatively attached to a vent tube at an upper end of the valve assembly.

28. A method for improving production in a wellbore, comprising:

inserting a gas operated pump into a lower wellbore, the gas operated pump including:

two or more chambers for the accumulation of formation fluids;

a valve assembly for filling and venting gas to and from the two or more chambers; and one or more removable one-way valves for controlling flow of the formation fluid in and out of the one or more chambers;

activating the gas operated pump;

cycling the gas operated pump to urge wellbore fluid out of the wellbore;

placing a fluid conduit at the lower end of the gas operated pump, the fluid conduit extending from a heel to a toe of the lower wellbore; and inserting a deployable cartridge into the production tubing to close the flow of formation fluid in the heel of the lower well, thereby allowing production only from the toe of the lower well.

29. The method of claim 28, repositioning the deployable cartridge in the production tubing to close the flow from the toe of the lower well and open the flow of formation fluid from the heel.

30. A method for improving production in a wellbore, comprising:

inserting a gas operated pump into a lower wellbore, the gas operated pump is connected to a collection system and the gas operated pump comprises:

two or more chambers for the accumulation of formation fluids;

a valve assembly for filling and venting gas to and from the two or more chambers; and one or more removable one-way valves for controlling flow of the formation fluid in and out of the one or more chambers;

activating the gas operated pump;

cycling the gas operated pump to urge wellbore fluid out of the wellbore; and collecting vented gas emitted by the gas operated pump into the collection system and transporting the gas to a steam generator to create steam.

31. The method of claim 30, further including injecting the steam into another wellbore for steam drive oil production.

32. A downhole pump assembly for use in a wellbore, comprising one or more chambers for the accumulation of formation fluids;

a valve assembly for filling and venting gas to and from the one or more chambers;

one or more removable one-way valves for controlling flow of formation fluid in and out of the one or more chambers; and at least one fluid conduit connectable to the one or more chambers, the at least one fluid conduit permitting flow of formation fluid from a heel and a toe of the wellbore, whereby the at least one fluid conduit is capable of receiving a deployable cartridge constructed and arranged to close the flow of formation fluid from the heel and/or the toe of the wellbore.

33. The downhole pump of claim 32, wherein the one or more removable one-way valves are housed in one or more deployable cartridges.

34. The downhole pump of claim 32, further including power supply lines for actuating the valve assembly.

35. The downhole pump of claim 34, wherein power supply lines include data transmitting means to transmit data such as pressure and temperature within the downhole pump.

36. The downhole pump of claim 35, wherein data transmitting means includes fiber optic cable.

37. The downhole pump of claim 32, further including a sensing mechanism operatively connected to the valve assembly to sense a liquid level in the wellbore.

* * * * *